US007910815B2

(12) United States Patent
Olsen

(10) Patent No.: US 7,910,815 B2
(45) Date of Patent: Mar. 22, 2011

(54) PRECISION AXIAL FLOW VALVE

(76) Inventor: Michael L. Olsen, Elk horn, WI (US)

( * ) Notice: Subject to any disclaimer, the term of this patent is extended or adjusted under 35 U.S.C. 154(b) by 55 days.

(21) Appl. No.: 12/488,370

(22) Filed: Jun. 19, 2009

(65) Prior Publication Data

US 2010/0319516 A1 Dec. 23, 2010

(51) Int. Cl.
*G10D 7/10* (2006.01)

(52) U.S. Cl. ..... 84/388

(58) Field of Classification Search ..... 84/388, 84/390

See application file for complete search history.

(56) References Cited

U.S. PATENT DOCUMENTS

| | | | | |
|---|---|---|---|---|
| 2,672,783 | A | 3/1954 | Kaufer | |
| 3,741,248 | A * | 6/1973 | Stevens, Jr. | 137/627 |
| 4,095,504 | A | 6/1978 | Hirsbrunner | |
| 4,469,002 | A * | 9/1984 | Thayer | 84/390 |
| 4,905,564 | A * | 3/1990 | Thayer | 84/390 |
| 5,361,668 | A | 11/1994 | Anderson et al. | |
| 5,686,678 | A * | 11/1997 | Greenhoe | 84/390 |
| 5,900,563 | A | 5/1999 | Leonard | |
| 6,018,115 | A | 1/2000 | Leonard | |
| 2004/0222400 | A1 * | 11/2004 | McCarty et al. | 251/344 |

* cited by examiner

*Primary Examiner* — Jianchun Qin

(74) *Attorney, Agent, or Firm* — Absolute Technology Law Group, LLC

(57) ABSTRACT

The present invention relates to the field of brass wind musical instruments, and more specifically to an improved axial flow valve which resists wear and optimizes air flow.

15 Claims, 6 Drawing Sheets

PRECISION AXIAL FLOW VALVE

FIELD OF INVENTION

The present invention relates to the field of brass wind musical instruments, and more specifically to an improved axial flow valve that resists wear and optimizes air flow.

GLOSSARY

Figure 1:
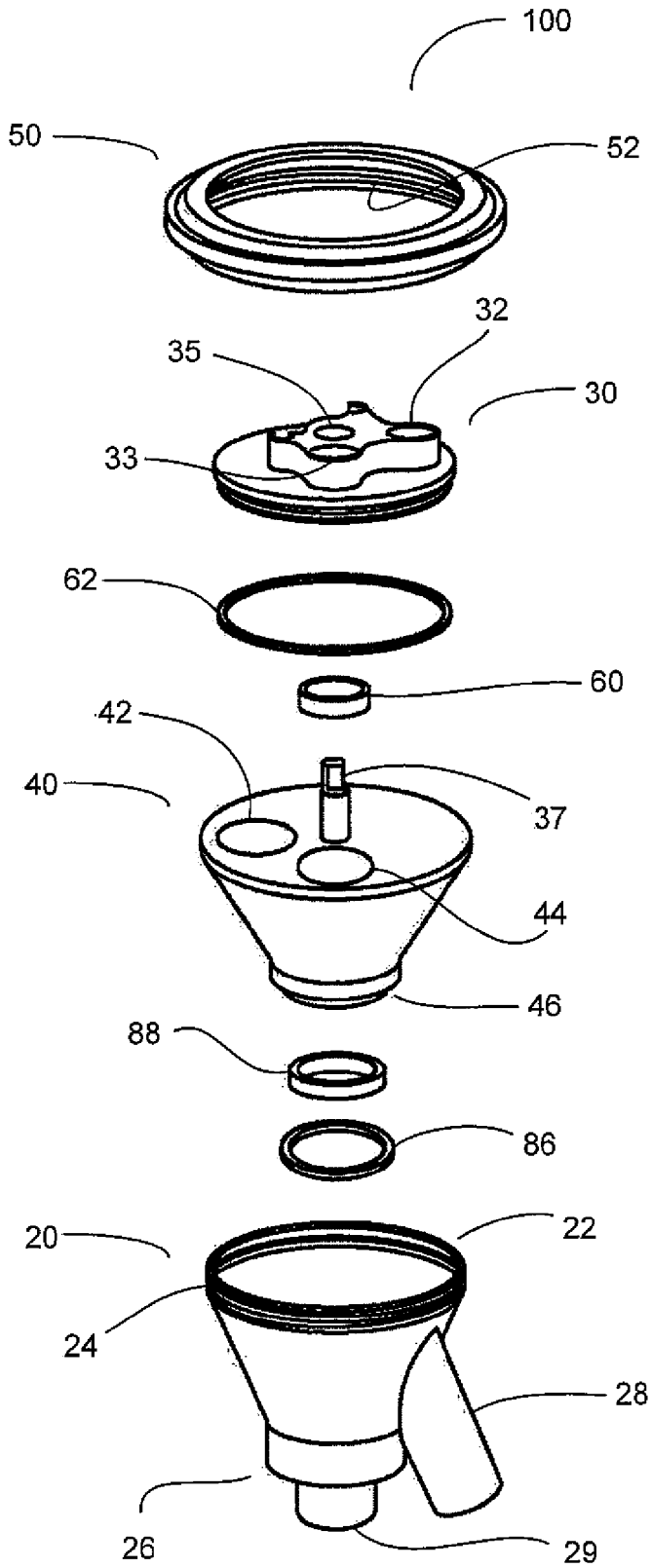
FIG. 1 is an exploded side perspective view of a precision axial flow valve.

As used herein, the term "axial flow valve" is a conically shaped rotor valve which includes valve housing, a rotor component, a back plate and optional components to improve performance (e.g., bearings and sealings). In various embodiments, an axial deflects the air flow through the instrument at an angle between 15 and 30 degrees (e.g., 28 degrees).

As used herein, the term "frusto-conical" means a solid or hollow elongated structure having a narrower diameter at one end.

As used herein, the term "valve housing" means a machined component adapted to receive a rotor component and back plate, and which may further be adapted to receive optional components such as seals and one or more bearings.

As used herein, the term "friction resistant" means having the capability of minimizing friction between the housing, rotor and back plate components of a valve.

As used herein, the term "bearing seat" means a specially machined or tooled recess on the inner surface of an axial flow valve housing adapted to receive a bearing, seal or other component.

As used herein, the term "bearing" or "friction reducing component" means a component, surface or substance that reduces the friction between two surfaces. For example, a bearing may be a ring which moves in a rotatable manner.

As used herein, the term "sealing ring" means any physical component which enhances or limits airflow for optimum valve performance and instrument tone quality. For example, a sealing ring may include, but not be limited to a plastic or rubber ring, an adhesive or moldable substance or a non-circular component to control air flow.

As used herein, the term "structural complement" means adapted to receive and/or fit within another component (e.g., a bearing, seal, lock ring or other component of an axial flow valve).

BACKGROUND

Various rotary axial valves are known in the art. One example is the "Thayer Valve" which is the subject of U.S. Pat. No. 4,469,002, filed in May 1982, issued in September 1984, and is now expired.

Rotary axial valves generally include housing and a rotor having at least two apertures extending through the rotor and the housing. At least one of the passages is substantially straight, while the other deflects the flow of air at an angle.

The apertures and passages are configured to align axially with the instrument's lead pipe, main bore, and slide loop ends to allow the user to better control airflow through these components and reduce the effort required to achieve a range of notes and tones.

A problem known in the art with traditional axial flow valves is that they are prone to wear because of the continuous friction between the rotor, housing and back plate.

Friction between these components will eventually compromise the seal of the valve necessary to direct airflow through the desired passages to achieve optimum tone quality.

Friction and the loss of seal within a valve result in costly repairs and replacements and compromised sound quality.

SUMMARY OF THE INVENTION

The present invention is an improved axial flow valve which is comprised of a contoured housing adapted to receive at least one bearing and which further includes at least one sealing ring that may be placed on the housing, rotor or back plate. Various embodiments of the invention may include a back plate that is also adapted to receive a friction-reducing bearing or friction-reducing contour.

DETAILED DESCRIPTION OF INVENTION

For the purpose of promoting an understanding of the present invention, references are made in the text to exemplary embodiments of a high precision axial flow valve for musical instruments, only some of which are described herein. It should be understood that no limitations on the scope of the invention are intended by describing these exemplary embodiments. One of ordinary skill in the art will readily appreciate that alternate but functionally equivalent high precision axial flow valves for musical instruments, only some of which are described herein, may be used. The inclusion of additional elements may be deemed readily apparent and obvious to one of ordinary skill in the art. Specific elements disclosed herein are not to be interpreted as limiting, but rather as a basis for the claims and as a representative basis for teaching one of ordinary skill in the art to employ the present invention.

It should be understood that the drawings are not necessarily to scale; instead emphasis has been placed upon illustrating the principles of the invention. In addition, in the embodiments depicted herein, like reference numerals in the various drawings refer to identical or near identical structural elements.

Moreover, the terms "substantially" or "approximately" as used herein may be applied to modify any quantitative representation that could permissibly vary without resulting in a change in the basic function to which it is related. For example, a high precision axial flow valve for musical instruments may have more or fewer bearings and seals, and the location or position of the bearing and sealing ring on the valve may vary.

FIG. 1 is an exploded side perspective view of an exemplary embodiment of a precision axial flow valve 100, which includes a substantially frusto-conical casing 20 comprised of wide end 22, threaded neck 24, narrowed end 26, and side exit tube 28 positioned at an angle relative to the outer surface of frusto-conical casing 20 and bottom exit tube 29. Bearing 88 is positioned within frusto-conical casing 20 on bearing seat 89 (not visible). Also shown is sealing ring 86.

The embodiment shown in FIG. 1 further includes a selectively attachable back plate 30, two apertures 32, 33 for directing airflow, and one bore 35 for inserting shaft 37. Frusto-conical casing 20 and back plate 30 are rotatably positioned around said shaft 37. Also visible are back plate bearing 60 and back plate sealing ring 62.

The embodiment shown in FIG. 1 further includes an inner rotor component 40 having two rotor apertures 42, 44 and narrow end 46 adapted to structurally complement bearing 88. FIG. 1 also shows lock ring 50 having threaded inner surface 52.

Figure 2:
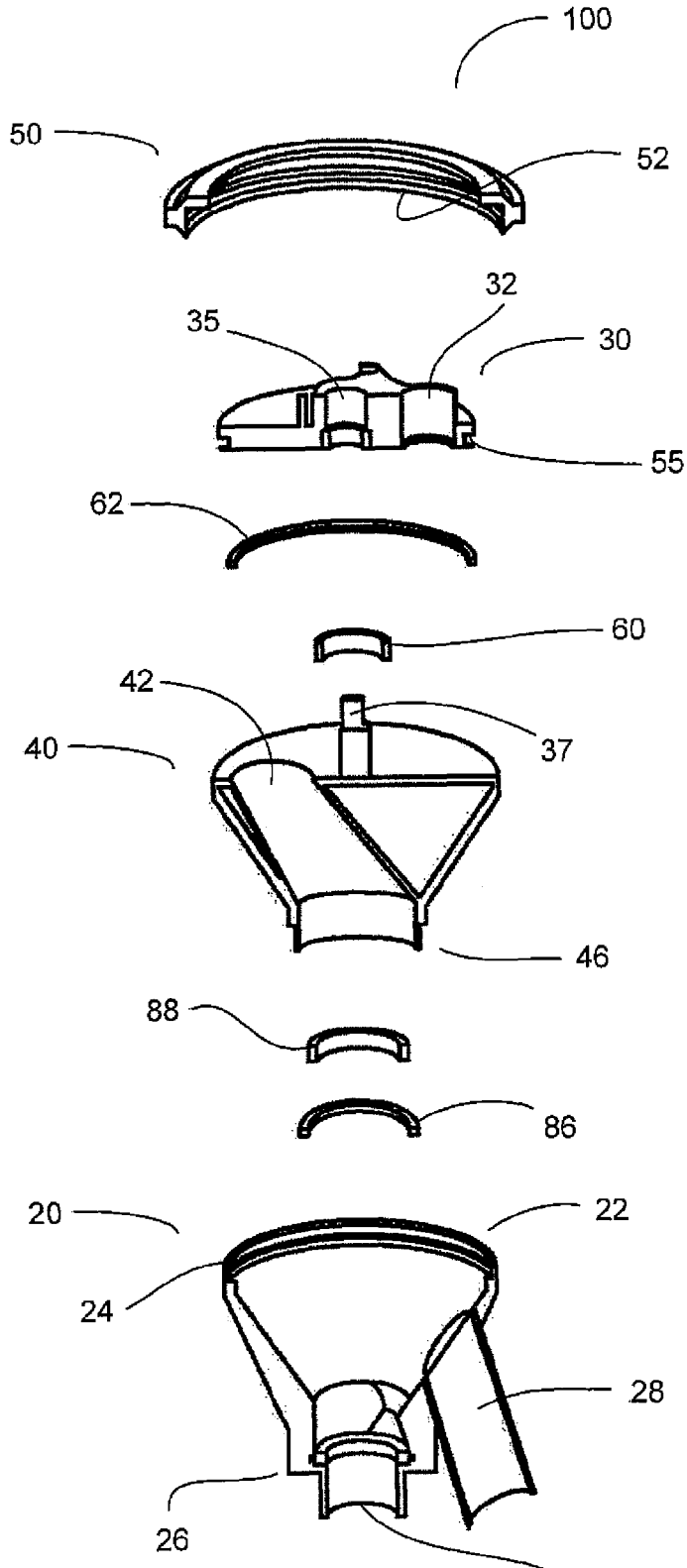
FIG. 2 is an exploded sectional view of a precision axial flow valve.

FIG. 2 is an exploded sectional view of FIG. 1 in which the inner contours of precision axial flow valve 100 are visible. Also visible in FIG. 2 is sealing ring groove 55 which is structurally adapted to receive sealing ring 62. Not visible in FIG. 2 are aperture 33 and rotor aperture 44.

Figure 3:
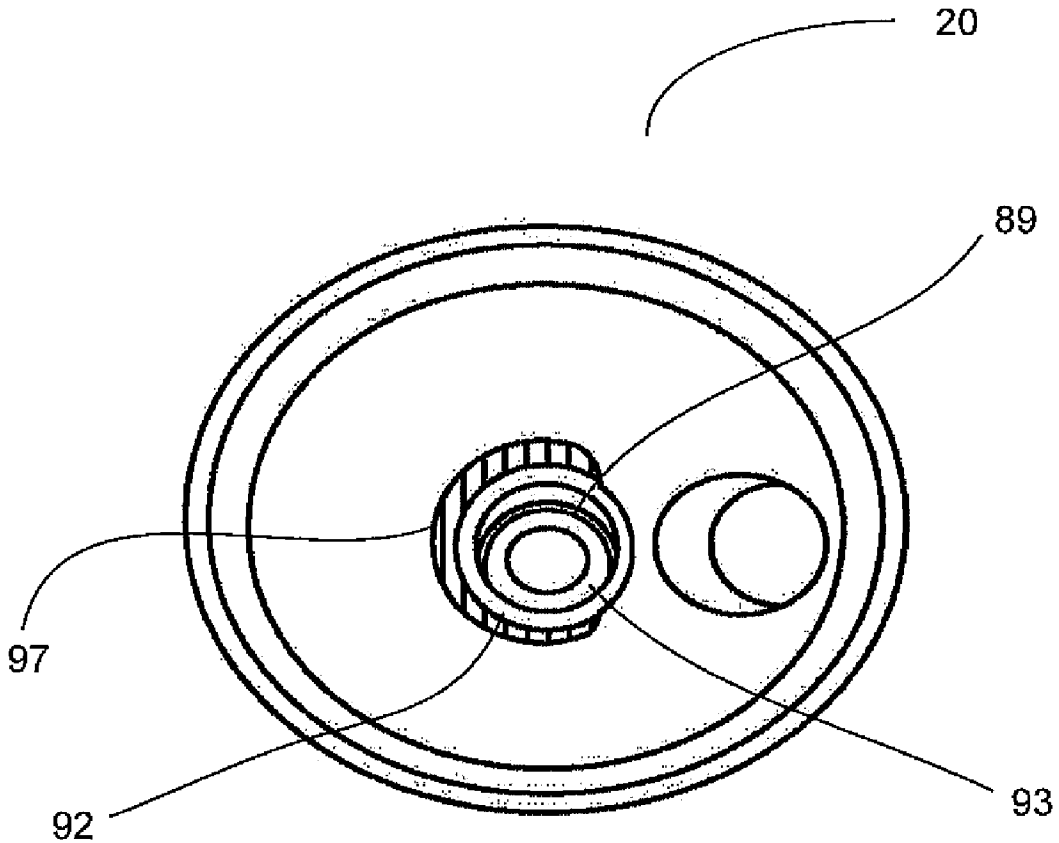
FIG. 3 is a top perspective view of the interior of the frusto-conical casing of a precision axial flow valve.

FIG. 3 illustrates a top perspective view of an exemplary embodiment of the interior of frusto-conical casing 20 in which bearing 88 (not shown) has been removed and in which bearing seat 89 is visible.

The exemplary embodiment of frusto-conical casing 20 shown in FIG. 3 further includes machined contour 97. In the embodiment shown, machined contour 97 includes contoured bore 92 and corresponding protuberance 93 adapted to receive a bearing having a diameter larger than the inner diameter of frusto-conical casing 20 without interfering with airflow when the bearing is positioned within frusto-conical casing 20. In other embodiments, machined contour 97 may be a uniform recess around the inner circumference of frusto-conical casing 20; in such embodiment, contoured bore 92 and corresponding protuberance 93 may be omitted.

Figure 4A:
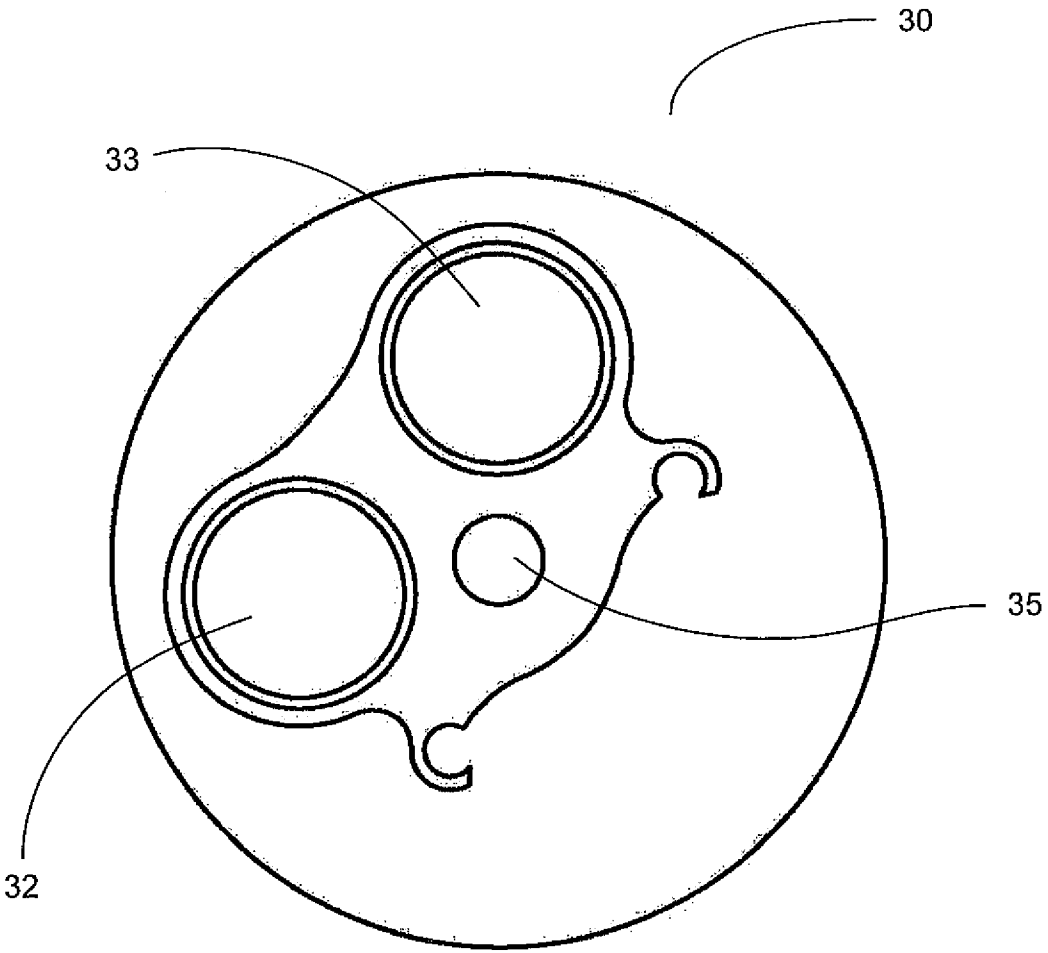
FIG. 4*a* is a top view of a back plate for a precision axial flow valve.

FIG. 4*a* is a top view of back plate 30 of precision axial flow valve 100 in which bore 35 and apertures 32, 33 are visible.

Figure 4B:
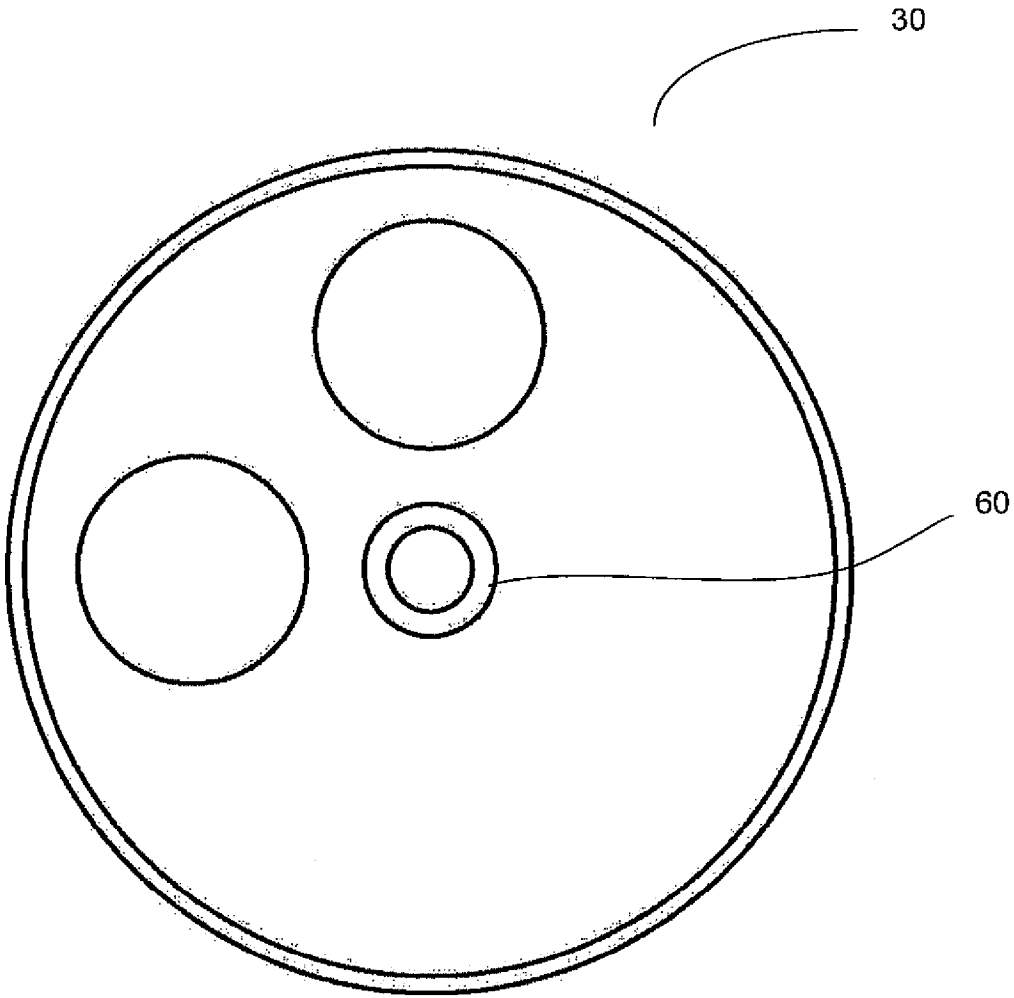
FIG. 4*b* is a bottom view of a back plate for a precision axial flow valve.

FIG. 4*b* is a bottom view of back plate 30 of precision axial flow valve 100 in which back plate bearing 60 is visible.

Figure 5:
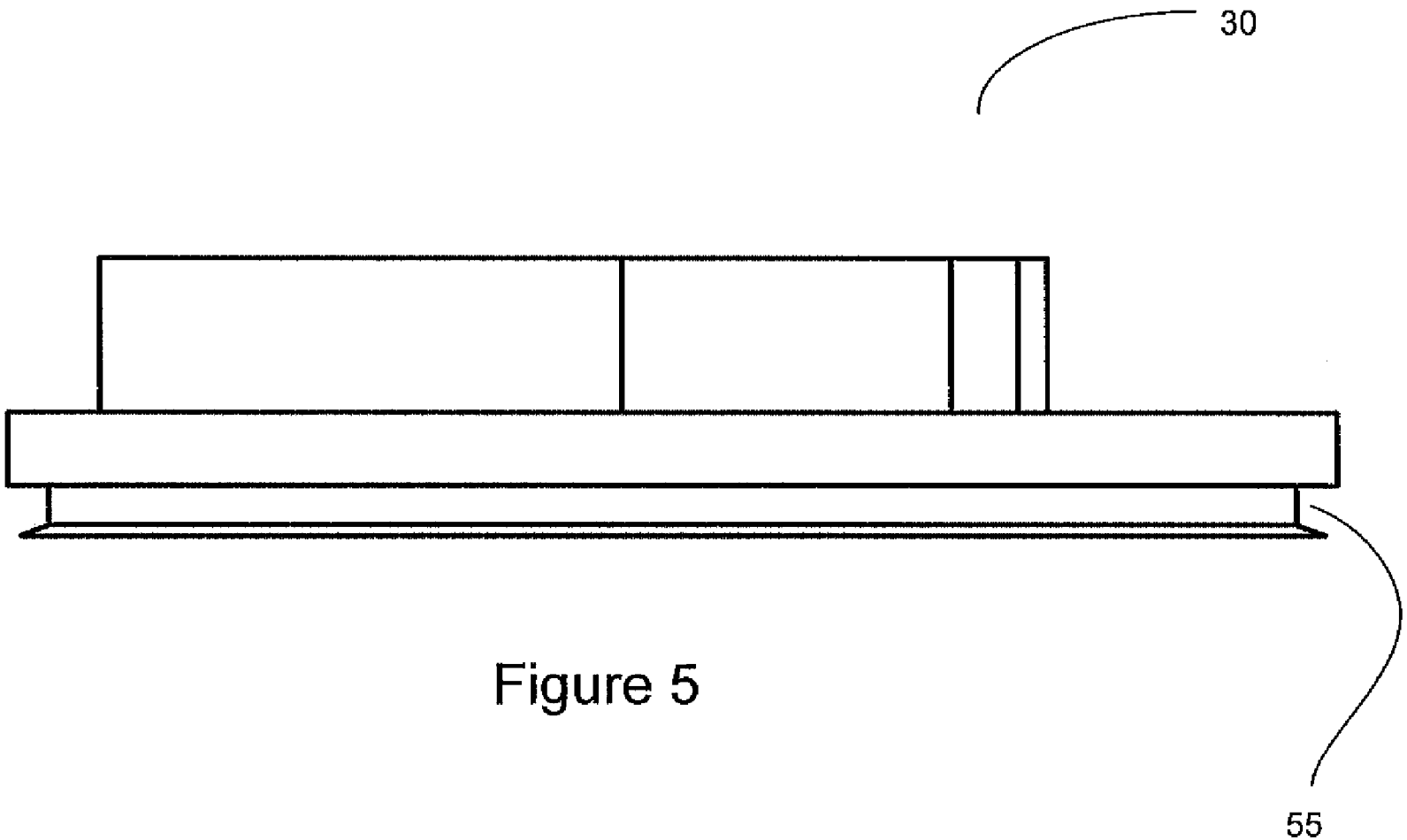
FIG. 5 is a side view of a back plate for a precision axial flow valve.

FIG. 5 is a side view of back plate 30 which illustrates sealing ring groove 55 which is a structural contour adapted to receive back plate sealing ring 62 (not shown).

What is claim is:

1. An axial flow valve for a musical wind instrument, said valve comprising:

a substantially frusto-conical casing comprised of a wide end, a threaded neck, a narrowed end, at least one side exit tube positioned at an angle relative to the outer surface of said frusto-conical casing, and at least one bottom exit tube;

a selectively attachable back plate having at least two apertures for directing airflow and at least one bore for inserting at least one shaft, said substantially frusto-conical casing and said back plate being rotatably positioned around said shaft;

an inner rotor component having at least two rotor apertures and a narrow end adapted to structurally complement a bearing;

a lock ring having a threaded inner surface;

at least one bearing located within said substantially frusto-conical casing; and at least one bearing seat;

wherein said substantially frusto-conical casing further includes at least one machined contour to accommodate said at least one bearing, said machined contour is comprised of a contoured bore and corresponding protuberance adapted to receive a bearing having a diameter larger than the inner diameter of said substantially frusto-conical casing without interfering with airflow when said bearing is positioned within said substantially frusto-conical casing.

2. The valve of claim 1 wherein said at least one bearing is sealed.

3. The valve of claim 1 wherein said substantially frusto-conical casing further includes at least one machined contour to accommodate said at least one bearing and at least one sealing ring.

4. The valve of claim 1 which further includes at least one sealing ring which encircles said at least one bearing.

5. The valve of claim 4 which further includes at least one sealing ring that encircles said at least one bearing, said at least one sealing ring being positioned in a machined contour.

6. The valve of claim 1 wherein said sealing ring is selected from a group consisting of a rubber ring, rubber tubing, tape, a metal ring, metal tubing, adhesive, silicones, plastics and combinations thereof.

7. The valve of claim 1 which further includes at least bearing positioned within said selectively attachable back plate.

8. The valve of claim 1 which further includes a sealing ring positioned within said selectively attachable back plate.

9. The valve of claim 1 wherein said selectively attachable back plate further includes a groove to accommodate a sealing ring.

10. The valve of claim 1 wherein said at least one bearing is positioned at the top of said at least one bottom exit tube of said substantially frusto-conical casing.

11. The valve of claim 1 wherein said at least one bearing is positioned at the top of said at least one side exit tube of said substantially frusto-conical casing, said frusto-conical casing being machined to form a bearing seat.

12. The valve of claim 1 wherein said at least one bearing further includes a sealing ring positioned within said at least one bearing.

13. An apparatus for a musical brass wind instrument comprised of:

an axial flow valve;

at least one bearing positioned within a selectively detachable back plate of said axial flow valve;

at least one sealing ring positioned within a sealing ring groove of said detachable back plate; and at least one bearing positioned within a frusto-conical casing of said axial flow valve; wherein said bearing is positioned within a machined contour comprised of a contoured bore and corresponding protuberance adapted to receive a bearing having a diameter larger than an inner diameter of said axial flow valve without interfering with airflow.

14. The apparatus of claim 13 which further includes at least one sealing ring which encircles said at least one bearing.

15. A method of manufacturing an axial flow valve comprised of the steps of:

machining a contour on the inner surface of a frusto-conical casing to accept a bearing;

wherein said contour is comprised of a contoured bore and corresponding protuberance adapted to receive a bearing having a diameter larger than the inner diameter of said frusto-conical casing without interfering with airflow when said bearing is positioned within said frusto-conical casing;

inserting a bearing into said contour;

machining a sealing ring groove on an axial flow valve back plate;

inserting a sealing ring into said sealing ring groove;

machining a contour on said axial flow valve back plate; and inserting a bearing into said contour.

* * * * *